US009902084B2

(12) United States Patent
Heinz et al.

(10) Patent No.: US 9,902,084 B2
(45) Date of Patent: Feb. 27, 2018

(54) DEVICE AND METHOD FOR PERFORMING CROSS CUTS ON WORKPIECES OF WOOD

(71) Applicant: Weinig Dimter GmbH & Co. KG, Illertissen (DE)

(72) Inventors: Alois Heinz, Unterroth (DE); Herbert Locherer, Laupheim (DE)

(73) Assignee: Weinig Dimter GmbH & Co. KG, Illertissen (DE)

( * ) Notice: Subject to any disclaimer, the term of this patent is extended or adjusted under 35 U.S.C. 154(b) by 125 days.

(21) Appl. No.: 14/817,478

(22) Filed: Aug. 4, 2015

(65) Prior Publication Data

US 2016/0031115 A1 Feb. 4, 2016

(30) Foreign Application Priority Data

Aug. 4, 2014 (DE) ..... 10 2014 011 689

(51) Int. Cl.

| | |
|---|---|
| ***B27B 11/00*** | (2006.01) |
| ***B27B 1/00*** | (2006.01) |
| ***B27M 1/08*** | (2006.01) |
| ***B27B 31/00*** | (2006.01) |

(52) U.S. Cl.

CPC ..... *B27B 1/002* (2013.01); *B27B 11/00* (2013.01); *B27B 31/003* (2013.01); *B27M 1/08* (2013.01)

(58) Field of Classification Search

CPC ..... B27M 1/08; B27B 11/00; B27B 1/002; B27B 31/003; B27B 1/00

See application file for complete search history.

(56) References Cited

U.S. PATENT DOCUMENTS

| | | | | |
|---|---|---|---|---|
| 5,617,910 | A * | 4/1997 | Hill | B27B 25/04 144/2.1 |
| 7,681,610 | B2 * | 3/2010 | McGehee | B27C 1/12 144/1.1 |
| 2007/0267104 | A1 | 11/2007 | McGehee et al. | |
| 2014/0290456 | A1 * | 10/2014 | Brooks | B26D 5/30 83/98 |

FOREIGN PATENT DOCUMENTS

| | | | |
|---|---|---|---|
| EP | 1842638 | A2 * | 10/2007 |
| EP | 2 251 169 | A1 | 11/2010 |

* cited by examiner

*Primary Examiner* — Stephen Choi
(74) *Attorney, Agent, or Firm* — Gudrun E. Huckett

(57) ABSTRACT

The device has a sawing station with cross-cut saw downstream of a feed transport device feeding workpieces to a transport unit of the sawing station that has a drive separate from that of the feed transport device. The feed transport device has a retaining/accumulating unit driven independently of a transport element of the feed transport device and subjecting the workpieces to a slower supply speed than the transport element. A transfer transport device is located between retaining/accumulating unit and sawing station. The drive of the transport element of the transfer transport device is controlled/adjusted independent of or by the drive of the retaining/accumulating unit via mechanically coupled step-up gear. The workpieces initially accumulate in the feed transport device and abut each other and are then transported onward with acceleration so that they are again spaced apart. The workpiece position is detected in the region of the transfer transport device.

8 Claims, 2 Drawing Sheets

DEVICE AND METHOD FOR PERFORMING CROSS CUTS ON WORKPIECES OF WOOD

BACKGROUND OF THE INVENTION

The invention pertains to a device for performing cross cuts on workpieces of wood, comprising at least one sawing station that features at least one cross-cut saw and is arranged downstream of at least one transport device, by means of which the workpieces are fed to the sawing station, wherein at least one transport unit, to which the workpieces are transferred, is located in said sawing station and features a drive separately of the transport device. The invention also pertains to a method for performing cross cuts on workpieces of wood, particularly with a device of the aforementioned kind, wherein the length of the workpieces as well as flaws in the workpieces are known and wherein the workpieces are subsequently transported into the sawing station in such a way that the gap between successive workpieces is minimized during the transfer to the cross-cut saw.

In some known devices, the transport device for supplying the workpieces is directly coupled to the feed of the cross-cut saw. Devices of this type only have a low throughput because the workpieces cannot be transported as long as the respectively leading workpiece is still processed by the cross-cut saw.

In other known devices, the transport device features a separate drive that supplies the next workpiece in response to a signal of the cross-cut saw. The throughput of such devices is also relatively low.

In yet other known devices, the workpieces are supplied to the sawing station by means of a controlled drive in such a way that the distance between successive workpieces is small during the transfer to the cross-cut saw.

The invention is based on the object of realizing a device of the initially cited type and a method of the initially cited type in such a way that cross cuts for removing workpiece flaws can be reliably performed with a simple design and a high throughput.

SUMMARY OF THE INVENTION

According to the invention, this object is achieved for a device of the aforementioned kind in that the feed transport device is on its end facing the sawing station provided with a retaining/accumulating unit that can be driven independently by a transport element of the feed transport device and subjects the workpieces to a slower supply speed than the transport element, wherein at least one transfer transport device is provided between the retaining/accumulating unit and the sawing station, wherein the transfer transport device features at least one transport element, the drive of which can be controlled/adjusted independently or by the drive of the retaining/accumulating unit via a mechanically coupled step-up gear.

According to the invention the object is further solved for the method of the aforementioned kind in that the workpieces are initially accumulated in a feed transport device such that they abut on one another with their end faces and form a line, in that the workpieces are subsequently transported onward in such an accelerated fashion that they are once again spaced apart from one another, and in that the position of the workpieces is detected in the region of the transfer transport device.

In the inventive device, the workpieces are transported in the direction of the sawing station on the feed transport device. A retaining/accumulating unit is located at the end of the feed transport device facing the sawing station. This retaining/accumulating unit ensures that the workpieces are held back. As a result, the workpieces are strung behind one another in a line such that they abut on one another with their end faces. The feed transport device with the retaining/accumulating unit thereby forms a buffer region, in which the workpieces are initially buffered. The retaining/accumulating unit is driven independently of the transport element of the feed transport device and subjects the workpieces to a slower supply speed than the supply speed generated by the transport element of the feed transport device. In this way, the string of workpieces can be very easily realized.

The transfer transport device, by means of which the workpieces are supplied to the sawing station, is located between the retaining/accumulating unit and the sawing station. Since the drive of the transport element of the transfer transport device is decoupled from the drive of the retaining/accumulating unit, it is possible to transport the workpieces onward in an accelerated fashion. The retaining/accumulating unit initially supplies the workpieces to the transport element of the transfer transport device with a slow speed. As soon as the workpieces are taken hold of by this transport element, they are transported onward in an accelerated fashion. As a result, the workpieces are separated such that they no longer abut on one another with their end faces. Since the drives of the transfer transport device and of the retaining/accumulating unit are decoupled from one another or coupled via a step-up gear, the drives can be respectively controlled or adjusted in such a way that the workpieces reach the cross-cut saw in the sawing station with a minimum distance between one another although the workpieces were initially arranged in-line on the feed transport device in an abutting fashion. In this way, a high throughput of workpieces can be achieved despite a simple design of the device.

The retaining/accumulating unit is advantageously formed by a pair of rolls. The two rolls form a roll gap, through which the workpieces can be transported. At least one of the two rolls is rotationally driven such that the workpieces can be reliably transported through the roll gap to the downstream transfer transport device.

An optimal operation of the device is achieved if the drive of the retaining/accumulating unit can be adjusted.

In order to ensure that the workpieces can be reliably transported through the roll gap, the rolls contact the workpieces with a certain pressure.

In an advantageous embodiment, the transfer transport device features pressing rolls that lie opposite of a transport element of the transfer transport device and rest on the workpieces under pressure.

In order to ensure a reliable transport of the workpieces through the device, the length of the transport element of the transfer transport device at least corresponds to the maximum length of the workpieces.

In order to optimize the transport of the workpieces to the cross-cut saw of the sawing station, at least one sensor, preferably a photocell, is advantageously provided in the region of the transfer transport device. The sensor makes it possible to detect the position of the workpieces on the transport element of the transfer transport device. If the transport element is driven, in particular, by means of a controlled drive, this makes it possible to minimize the distance between successive workpieces in the sawing station with consideration of the respective position of the workpiece.

In a preferred embodiment, the drives of the transport elements of the feed transport device and the transfer transport device, the retaining/accumulating unit and the transport unit in the region of the cross-cut saw in the sawing station are connected to a control unit. This control unit can control or preferably also adjust the individual drives as a function of the available data such that an optimal throughput of workpieces through the device is achieved.

In the inventive method, the workpieces are initially held back such that they abut on one another with their end faces and form a continuous string. Subsequently, the workpieces are individually transported onward in such an accelerated fashion that they are once again spaced apart from one another. The workpieces can then be reliably supplied to the cross-cut saw in the sawing station. The position of the workpieces, which is taken into consideration during the supply of the workpieces to the sawing station, is detected in the region of the transfer transport device.

A sound throughput of workpieces is achieved if the acceleration of the workpieces is realized as a function of the transport of the workpieces in the region of the cross-cut saw in the sawing station. The respectively trailing workpiece can then be supplied in such a way that its distance from the leading workpiece is minimal. In this case, the distance is advantageously so small that successive workpieces almost contact one another in the transfer region to the cross-cut saw within the sawing station.

In order to achieve a high throughput, it is advantageous to adjust the supply speed of the respectively trailing workpiece into the sawing station. This makes it possible to optimally adjust the supply speed of the trailing workpiece as a function of the processing time of the respectively leading workpiece in the sawing station.

The supply speed of the respectively trailing workpiece in the transfer transport device preferably is variably adjusted such that the throughput of workpieces can be additionally optimized.

The supply speed of the respectively trailing workpiece in the transfer transport device preferably is continuously calculated anew in a control unit. In this way, the distance between successive workpieces can always be maintained small or minimal.

It is advantageous if the control unit operates with continuous position tracking of the workpieces. In this way, the different drives for the respective transport elements can be optimally adapted to one another.

The measured values of the workpieces are advantageously stored. The measured and the stored values can then be used for adjusting the supply speed of the workpieces.

In one embodiment, the respectively trailing workpieces are fed to the sawing station without interruption of the supply speed in the transfer transport device.

The drive for transporting the trailing workpieces by means of the transfer transport device is advantageously decoupled from the drive of the workpieces in the sawing station. In this way, the transport of the workpieces within the sawing station can take place in a stop-and-go mode whereas the supply of the workpieces to the sawing station takes place continuously, if applicable also with variable speed.

The object of the application is not only defined by the objects of the individual claims, but also by all information and characteristics disclosed in the drawings and the description. Even if they are not objects of the claims, they are claimed as essential to the invention if they are novel in comparison with the prior art individually or in combination.

Additional characteristics of the invention result from the other claims, the description and the drawings.

BRIEF DESCRIPTION OF THE DRAWINGS

The invention is described in greater detail below with reference to an exemplary embodiment that is illustrated in the drawings. In these drawings.

DESCRIPTION OF PREFERRED EMBODIMENTS

Figure 1:
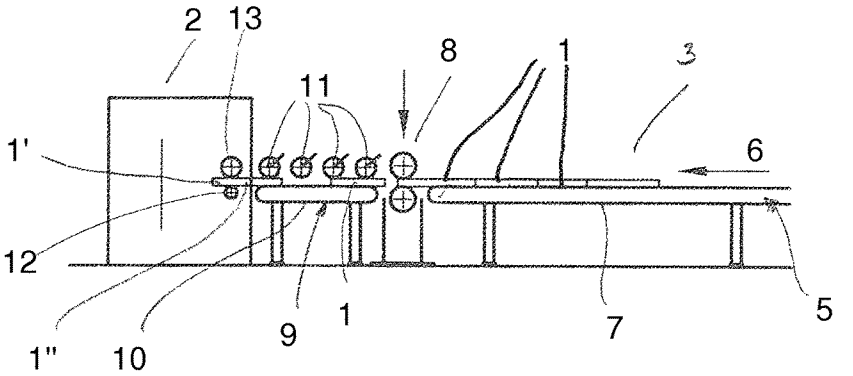
FIG. 1 shows a schematic side view of an inventive device for chop-cutting workpieces.

The device serves for supplying workpieces 1 in the form of elongate lumbers to a sawing station 2, in which flaws in the workpieces 1 are cut out by means of a (not-shown) cross-cut saw. The workpieces 1 have a length of less than approximately 1,200 mm.

The sawing station 2 is arranged downstream of a buffer region 3, in which the workpieces 1 are held back in such a way that they abut one another with their end faces 4. The buffer region 3 has at least one feed transport device 5, by means of which the workpieces 1 are transported to the sawing station 2 in the transport direction 6. The feed transport device 5 features a transport element 7 that may consist of an endless revolving conveyor belt or an endless revolving chain and is driven in the transport direction 6. The transport element may also consist of a roller conveyor, the driven rollers of which transport the workpieces 1 in the transport direction 6.

The buffer region 3 or the feed transport device 5 respectively features a pair of rolls 8 that are rotatable about horizontal axes on the front end referred to the transport direction 6, wherein said rolls are located in the region above and underneath the transport path of the workpieces 1 in the direction of the sawing station 2. The pair of rolls 8 is driven independently of the transport element 7. In order to achieve a reliable transport of the workpieces 1, the rolls 8 contact the upper side and the underside of the respective workpieces 1 with a certain pressure. In order to build up this pressure, the rolls 8 are pressed against the workpiece 1 hydraulically, pneumatically or even by means of a spring force. The pressure exerted upon the workpieces 1 by the rolls 8 is adjusted in such a way that slippage between the workpieces 1 and the rolls 8 is prevented. Both rolls 8 or only one of the rolls may be rotationally driven about the respective horizontal axis in order to transport the workpieces 1 in the roll gap. When the rolls 8 are acted upon with pressure hydraulically or pneumatically, in particular, the corresponding hydraulic or pneumatic cylinders may be controlled in such a way that the contact pressure of the rolls 8 on the upper side and the underside of the workpieces 1 is sufficiently high for preventing slippage between the workpieces 1 and the rolls 8. In this context, it would be possible to monitor the contact pressure of the rolls on the workpiece 1 with suitable sensors. If the sensors detect slippage between the workpiece 1 and the rolls 8, they generate a corresponding signal, by means of which the hydraulic or pneumatic cylinders are controlled such that the contact pressure is increased until the slippage has disappeared.

Figure 2:
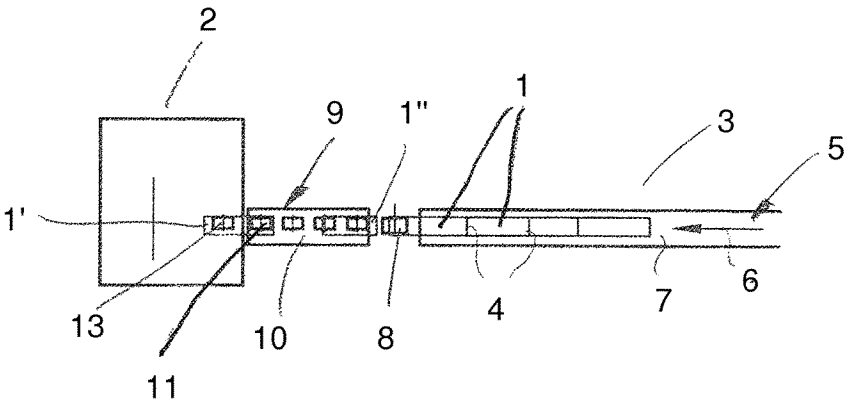
FIG. 2 shows a top view of the device according to FIG. 1.
Figure 3:
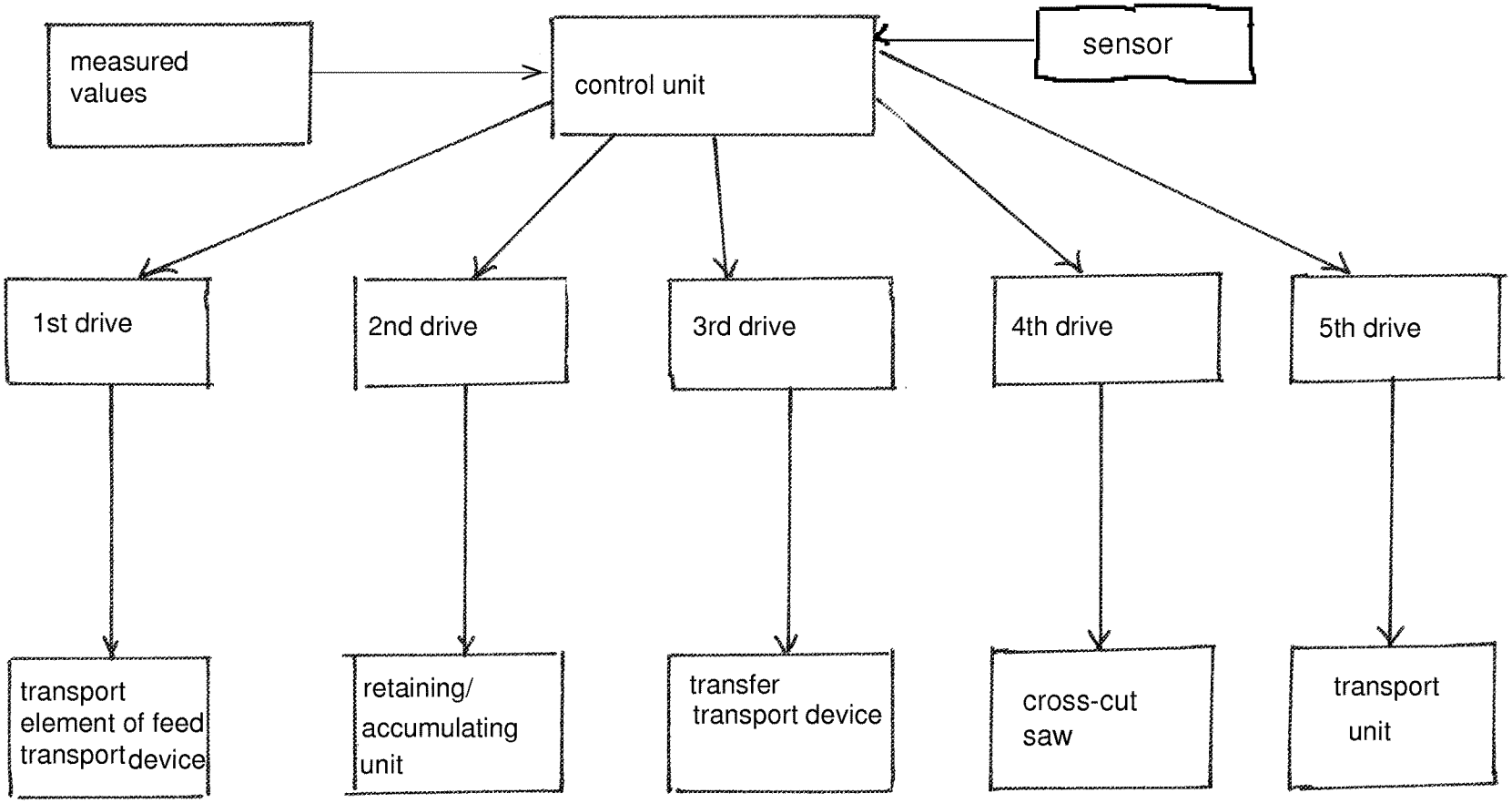
FIG. 3 shows a schematic illustrating control unit and drives controlled by the control unit.

During the operation, the rolls 8 are rotationally driven in such a way that the workpieces 1 taken hold of thereby have a slower speed than the trailing workpieces 1 transported on the transport element 7 of the feed transport device 5. In this way, the workpieces 1 accumulate on the feed transport device 5 in such a way that they abut on one another with their end faces 4 as illustrated in FIGS. 1 and 2.

The rolls 8 advantageously are rotationally driven by means of a controlled drive that may consist of a servo drive, a FU-drive or a hydraulic drive. The controlled drive makes it possible to optimally adjust the transport speed of the workpieces 1. The control is realized with respect to the speed of the transport element 7, as well as with respect to the transport speed of a transfer transport device 9 that is arranged downstream of the pair of rolls and embodies a transfer transport device by means of which the workpieces 1 are transferred to the sawing station 2. The transfer transport device 9 features a transport element 10 that advantageously consists of an endless revolving conveyor belt. At least one endless revolving chain or a roller conveyor may also be provided instead of the conveyor belt. The transport element 10 is driven in such a way that the workpieces 1 lying thereon are fed to the downstream sawing station 2. In order to ensure a reliable transport of the workpieces 1 by means of the transport element 10, pressing rolls 11 are located a certain distance above the transport element 10 and rest on the workpieces 1 under pressure during the transport by means of the transfer transport device 9. The pressing rolls 11 can be adjusted perpendicular to the transport element 10 and thereby adapted to different workpiece thicknesses. The pressing rolls 11 prevent the workpieces 1 from sliding on the transport element 10.

The drive of the transport element 10 is realized independently of the drive of the pair of rolls 8, as well as the drive of the transport element 7 of the feed transport device 5.

The drive of the transport element 10 may also be realized in the form of a controlled drive.

The transport element 10 has a length that at least corresponds to the maximum length of the workpieces 1. This ensures that even the longest workpiece 1 completely lies on the transport element 10 and no longer protrudes into the gap between the pair of rolls 8. The pressing rolls 11 are arranged behind one another and spaced apart by a certain distance in the transport direction 6 of the workpieces 1. In this case, the distance between successive pressing rolls 11 is so small that very short workpieces 1 can also be taken hold of by the pressing rolls 11.

During the operation of the device, the transport element 10 is driven in such a way that the workpieces 1 transported thereby have a higher speed than in the region between the pair of rolls 8. In this way, the workpieces 1, which abut on one another with their end faces 4 in the buffer region 3, no longer abut before they enter the sawing station 2, but rather are spaced apart from one another in the transport direction 6. In FIGS. 1 and 2, this is illustrated using the example of two successively arranged workpieces 1', 1" in the region of the transfer transport device 9. The left workpiece 1' still lies on the transport element 10 with its rear end referred to the transport direction, wherein this workpiece end is subjected to pressure in the direction of the transport element 10 by the last pressing roll 11. At the same time, the front end of this workpiece 1' referred to the transport direction lies on a transport element 12, against which this workpiece end is pressed by means of a pressing roll 13. The transport element 12 and the pressing roll 13 form part of a transport unit of the sawing station 2 by means of which the workpieces 1 are fed to the cross-cut saw.

The workpiece 1" also lies on the transport element 10 on the rear end referred to the transport direction 6 and is pressed against the transport element 10 by the corresponding pressing rolls 11. The two workpieces 1', 1" on the transport element 10 are spaced apart from one another due to the fact that the transport speed of the transport element 10 is higher than the transport speed of a pair of rolls 8. The workpieces 1, which still abut on one another in the buffer region 3, therefore are pulled apart such that a gap is formed in between before the workpieces 1 are transported into the sawing station 2 by means of the transfer transport device 9.

The cross-cut saw arranged in the sawing station 2 performs the required cross cuts on the workpieces 1 in order to remove poor lumber qualities and/or flaws from the workpiece 1.

The poor lumber qualities and/or flaws to be cut out of the workpiece 1 are detected in a (not-shown) station arranged upstream of the buffer region 3. This detection may be realized by means of a scanner or in a chalk-type measuring station. The length of the workpieces 1 is also measured in this upstream station. The respective lengths as well as the locations, at which the cross cuts should be performed on the workpiece 1, are stored in a control unit. The thusly prepared cutting list is transmitted to the sawing station 2, the cross-cut saw of which performs the necessary cross cuts at the required locations of the workpieces 1 in accordance with this cutting list. The cutting list is furthermore transmitted to a master control unit that controls the drives of the feed transport device 5 and the transfer transport device 9 and the pair of rolls 8.

The workpieces 1 respectively have a different number of flaws. This means that a different number of cross cuts needs to be performed on the workpieces 1 in the sawing station 2. This in turn means that the workpieces 1 are located in the sawing station 2 for different time periods before they exit the sawing station. The transport speeds of the respectively trailing workpieces 1 accordingly have to be adjusted in such a way that the trailing workpiece 1 does not prematurely reach the region of the cross-cut saw while the leading workpiece is still processed thereby. On the other hand, the distance between successive workpieces within the sawing station 2 should be a small as possible in order to achieve a maximum throughput of workpieces in the sawing station 2.

In order to advantageously promote this objective, the rear end of the workpiece 1 located in the sawing station 2 referred to the transport direction is monitored in the sawing station 2 by means of a (not-shown) sensor. The position of this board end in the sawing station 2 is therefore known.

At least one additional (not-shown) sensor is positioned in the transfer transport device 9 and measures the position of the workpiece 1 located in the transfer transport device 9. Since the length of the respective workpiece 1 also was previously determined, the master control unit can drive the pair of rolls 8 in such a way that the distance from the leading workpiece 1 is minimized during the transfer of the trailing workpiece 1 to the cross-cut saw in the sawing station 2. This distance in front of the cross-cut saw is so small that the successive workpieces 1 almost contact one another.

During the operation of the device, the length of the workpieces 1 is initially measured in the station arranged upstream of the buffer region 3. In addition, poor wood qualities and/or flaws are marked on the workpieces in this region such that the cross-cut saw in the sawing station 2 performs the cross cuts at the required locations. The thusly measured and marked workpieces 1 then reach the transport element 7 of the buffer region 3 and are transported in the direction of the pair of rolls 8 by this transport element. The transport speed of the feed transport device 5 in the buffer region 3 is higher than the transport speed generated by the pair of rolls 8 such that the workpieces 1 accumulate on the pair of rolls 8, i.e. at the end of the buffer region 3, and abut on one another with their end faces 4.

The pair of rolls 8 feeds the workpieces 1 to the downstream transfer transport device 9 located between the sawing station 2 and the pair of rolls 8, as well as the buffer region 3. The transport element 10 of the transfer transport device 9 is driven in such a way that its transport speed is higher than the transport speed generated by the pair of rolls 8. This causes the successively arranged workpieces 1 to separate from one another.

The transfer transport device 9 transports the workpieces 1 into the sawing station 2, in which the workpieces are fed to the cross-cut saw by means of a (only schematically indicated) transport unit 12, 13. This saw performs the previously defined cuts on the workpieces 1. The workpiece 1 is at a standstill while a saw cut is performed. The workpiece therefore is transported incrementally when several cuts need to be performed.

The position of the respectively trailing workpiece 1 is detected by the sensor in the region of the transfer transport device 9. The position values are transmitted to the control unit together with the lengths of the workpieces, as well as the speeds of the transfer transport device 9 and the pair of rolls 8. The control unit calculates the required supply speed of the respectively trailing workpiece 1 from these values and adjusts the drives of the pair of rolls 8 and the transfer transport device 9 accordingly. The supply speed of the respectively trailing workpiece 1 is continuously calculated anew in the control unit. In this way, the workpieces 1 are always fed to the sawing station 2 by the transfer transport device 9 in such a way that the distance between the trailing workpiece 1 and the leading workpiece 1 still being processed by the cross-cut saw is minimal. In this context, minimal distance means that the successive workpieces 1 are during the transfer to the cross-cut saw only spaced apart from one another by such a small distance that they almost contact one another. The gap between the successive workpieces to be processed by means of the cross-cut saw is thereby minimized during the transfer of the workpieces to the cross-cut saw. The control or adjustment is advantageously realized in such a way that the workpieces 1 are fed to the sawing station 2 without standstill. It is advantageous to control the supply speed of the transfer transport device 9 variably, wherein the supply speed is continuously calculated anew in the control unit.

The transport of the respectively trailing workpieces 1 can also be interrupted or stopped depending on the processing time of the workpieces 1 in the sawing station 2.

Since the workpieces 1 are initially buffered in the buffer region 3 such that they abut on one another with their end faces 4, a simple supply of the workpieces can be realized after the measuring process. The pair of rolls 8 ensures that the workpieces 1 are assembled into a string after the measuring process. No complicated drives are required for this purpose. The pair of rolls 8 not only ensures that the workpieces 1 are strung in a line in the buffer region 3, but also that the workpieces 1 are transferred to the transfer transport device 9 located between the sawing station 2 and the buffer region 3 as a function of the cross cuts in the sawing station 2, namely in such a way that said transport device can in turn feed the workpieces to the cross-cut saw in the sawing station 2 such that the distance from the leading workpiece 1 is minimized during the transfer of the respectively trailing workpiece 1 to the cross-cut saw.

The specification incorporates by reference the entire disclosure of German priority document 10 2014 011 689.1 having a filing date of Aug. 04, 2014.

While specific embodiments of the invention have been shown and described in detail to illustrate the inventive principles, it will be understood that the invention may be embodied otherwise without departing from such principles.

What is claimed is:

1. A method for performing cross cuts on elongate workpieces of wood, the method comprising:

producing a cutting list by determining measured values of the elongate workpieces, the measured values including a length of the elongate workpieces and locations of flaws of the elongate workpieces, respectively, and supplying the cutting list to a control unit;

transporting the elongate workpieces lengthwise in a transport direction along a transport path from a feed transport device to a transport unit of a sawing station comprising a cross-cut saw;

accumulating the elongate workpieces by a retaining/accumulating device downstream of the feed transport device such that the elongate workpieces abut one another with their end faces in a head-to-tail arrangement and form a line;

accelerating the elongate workpieces by a transfer transport device downstream of the retaining/accumulating device such that the elongate workpieces are once again separated and spaced apart from one another;

transferring the elongate workpieces, spaced apart from one another, by the transfer transport device into the sawing station;

controlling by the control unit based on the cutting list a drive of the feed transport device, a drive of the retaining/accumulating unit, a drive of the transfer transport device, and a drive of the transport unit of the sawing station, wherein the drive of the transfer transport device and the drive of the transport unit of the sawing station are decoupled from each other, such that a gap between successive elongate workpieces during transfer to the cross-cut saw of the sawing station is minimized to such a small distance that the elongate workpieces do not abut but almost contact one another.

2. The method according to claim 1, further comprising adjusting in the step of accelerating an acceleration of the elongate workpieces as a function of a position of the elongate workpieces in the sawing station in the region of the cross-cut saw.

3. The method according to claim 1, further comprising adjusting in the transfer transport device a supply speed at which a respective trailing workpiece is supplied into the sawing station.

4. The method according to claim 1, further comprising variably adjusting in the transfer transport device a supply speed at which a respective trailing workpiece is supplied into the sawing station.

5. The method according to claim 1, further comprising continuously recalculating in the control unit a supply speed of the transfer transport device at which a respective trailing workpiece is supplied into the sawing station.

6. The method according to claim 5, further comprising operating the control unit with continuous position tracking of the elongate workpieces along the transport path.

7. The method according to claim 1, further comprising employing the measured values of the cutting list for regulating a supply speed of the elongate workpieces.

8. The method according to claim 1, further comprising feeding trailing elongate workpieces to the sawing station without interruption of a supply speed.

* * * * *